US010954617B2

(12) United States Patent
Marijsse

(10) Patent No.: US 10,954,617 B2
(45) Date of Patent: Mar. 23, 2021

(54) METHOD OF PREPARING A TUFTING PROCESS FOR TUFTING FABRIC, IN PARTICULAR CARPET

(71) Applicant: Vandewiele NV, Kortrijk/Marke (BE)

(72) Inventor: Frank Marijsse, Kortrijk (BE)

(73) Assignee: VANDEWIELE NV, Kortrijk/Marke (BE)

( * ) Notice: Subject to any disclaimer, the term of this patent is extended or adjusted under 35 U.S.C. 154(b) by 63 days.

(21) Appl. No.: 16/339,424

(22) PCT Filed: Oct. 27, 2017

(86) PCT No.: PCT/EP2017/077663
§ 371 (c)(1),
(2) Date: Apr. 4, 2019

(87) PCT Pub. No.: WO2018/083041
PCT Pub. Date: May 11, 2018

(65) Prior Publication Data

US 2020/0040500 A1 Feb. 6, 2020

(30) Foreign Application Priority Data

Nov. 4, 2016 (EP) ..... 16197301

(51) Int. Cl.
*D05C 15/26* (2006.01)

(52) U.S. Cl.
CPC ..... *D05C 15/26* (2013.01)

(58) Field of Classification Search
USPC ..... 700/136; 112/475.23, 80.01
See application file for complete search history.

(56) References Cited

U.S. PATENT DOCUMENTS 3,568,614 A * 3/1971 Shorrock ..... D03C 3/20 112/80.23
4,686,918 A * 8/1987 Hjalmer ..... D05B 21/007 112/410

(Continued)

FOREIGN PATENT DOCUMENTS

EP 2077348 7/2009
EP 2077348 A1 * 7/2009 ..... D05C 15/18

(Continued)

OTHER PUBLICATIONS

International Search Report filed in PCT/EP2017/077663 dated Feb. 2, 2018.

*Primary Examiner* — Nathan E Durham
*Assistant Examiner* — Grace Huang
(74) *Attorney, Agent, or Firm* — Rankin, Hill & Clark LLP

(57) ABSTRACT

A method of preparing a tufting process for tufting a fabric comprises the steps of: a) providing a pattern representation (10) representative of a fabric to be tufted comprising at least one tufting structure region (14), said at least one tufting structure region (14) corresponding to an area of the fabric to be tufted having a plurality of piles, b) in association with at least one tufting structure region (14), providing a tufting structure defined by a plurality of tufting structure parameters, each tufting structure parameter having an effect on the appearance of at least a part of the piles to be tufted in association with this tufting structure region and having no effect on the appearance of piles to be tufted in an area not corresponding to this tufting structure region (14).

12 Claims, 3 Drawing Sheets

(56) References Cited

U.S. PATENT DOCUMENTS

| | | | | | |
|---|---|---|---|---|---|
| 5,392,723 | A * | 2/1995 | Kaju | D05C 15/26 | 112/80.23 |
| 6,807,917 | B1 * | 10/2004 | Christman | D05C 15/34 | 112/475.23 |
| 7,356,453 | B2 * | 4/2008 | Gould | A47G 27/0275 | 345/582 |
| 8,126,584 | B2 * | 2/2012 | Yamada | D05B 19/10 | 700/138 |
| 8,155,776 | B2 * | 4/2012 | Bittner | A47G 27/0275 | 700/131 |
| 8,267,023 | B2 * | 9/2012 | Samilo | D05C 15/18 | 112/80.01 |
| 8,359,989 | B2 * | 1/2013 | Hall | D05C 15/34 | 112/80.23 |
| 8,705,139 | B1 * | 4/2014 | Snyder | H04N 1/387 | 358/3.27 |
| 2009/0260554 | A1 | 10/2009 | Hall | | |
| 2013/0014682 | A1 * | 1/2013 | Brindzik | D05C 5/04 | 112/475.19 |
| 2013/0047904 | A1 * | 2/2013 | Vaughan | D05B 19/10 | 112/80.23 |
| 2015/0159323 | A1 * | 6/2015 | Hall | D05C 17/026 | 428/92 |

FOREIGN PATENT DOCUMENTS

| | | | | |
|---|---|---|---|---|
| GB | 2319786 | | 6/1998 | |
| GB | 2319786 | A * | 6/1998 | D05C 17/026 |

* cited by examiner

| | | | | | |
|---|---|---|---|---|---|
| 2 | 5 | 5 | 3 | 8 | 8 |
| 2 | 5 | 5 | 3 | 8 | 8 |
| 2 | 5 | 5 | 3 | 8 | 8 |
| 2 | 5 | 5 | 3 | 8 | 8 |
| 2 | 5 | 5 | 3 | 8 | 8 |
| 2 | 5 | 5 | 3 | 8 | 8 |
| 3 | 8 | 8 | 2 | 5 | 5 |
| 3 | 8 | 8 | 2 | 5 | 5 |
| 3 | 8 | 8 | 2 | 5 | 5 |
| 3 | 8 | 8 | 2 | 5 | 5 |
| 3 | 8 | 8 | 2 | 5 | 5 |
| 3 | 8 | 8 | 2 | 5 | 5 |

26

METHOD OF PREPARING A TUFTING PROCESS FOR TUFTING FABRIC, IN PARTICULAR CARPET

The present invention relates to a method of preparing a tufting process for tufting a fabric, for example, a carpet.

When tufting fabrics, starting out from an artistic representation which, for example, may be a picture or a drawing, in association with each pile to be tufted, the type of the pile, the height of the pile and, in some cases, even the color of the pile has to be determined. On the basis of this information relating to all the piles which have to be present in a fabric to be tufted, a tufting machine control file is generated and a tufting machine is operated on the basis of this tufting machine control file.

Sometimes deficiencies occurring when transferring the information contained in the artistic representation to the data contained in the tufting machine control file become visible only after having tufted a fabric. Carrying out changes to the tufting machine control file and the data used for generating the tufting machine control file, respectively, for overcoming such deficiencies often is a very time-consuming and complex task, as this requires variations on the level of the pixels of a pixel grid representative of all the piles to be tufted.

It is an object of the present invention to provide a method of preparing a tufting process for tufting a fabric, in particular carpet, allowing an easy variation of the structure and/or the optical appearance of a fabric to be tufted.

According to the present invention, this object is achieved by a method of preparing a tufting process for tufting a fabric, in particular carpet, comprising the steps of:

a) providing a pattern representation representative of a fabric to be tufted comprising at least one tufting structure region corresponding to an area of the fabric to be tufted having a plurality of piles, b) in association with at least one tufting structure region, providing a tufting structure defined by a plurality of tufting structure parameters, each tufting structure parameter having an effect on the appearance of at least a part of the piles to be tufted in association with this tufting structure region and having no effect on the appearance of piles to be tufted in an area not corresponding to this tufting structure region.

According to the method of the present invention, regions corresponding to areas of a fabric to be tufted having a particular structure and/or optical appearance are defined. In association with these tufting structure regions, tufting structures are defined and provided, respectively, which tufting structures are representative of the structure and/or the optical appearance of each one of these regions.

A first tufting structure may define a variation of the pile height within a tufting structure region having the first tufting structure associated therewith, and the tufting structure parameters of the first tufting structure may comprise the direction of variation and the extent of variation. For example, the extent of variation may be defined by a maximum pile height and a minimum pile height.

For increasing the options of providing the structure and/or the optical appearance of a particular area of a fabric to be tufted, the tufting structure parameters of the first tufting structure may further comprise the kind of variation of the pile height, and/or may further comprise the number of repetitions of the variation of the pile height within the associated tufting structure region. For example, the kind of variation may be defined as a linear variation, a parabolic variation, a hyperbolic variation, a sinusoidal variation or a stepped variation. By providing a plurality of repetitions of the variation, for example, an undulated surface structure or a saw tooth surface structure can be obtained.

According to the present invention, a second tufting structure may define the repetition of a predetermined tufting structure element, the predetermined tufting structure element defining a plurality of piles to be tufted adjacent to each other in a first direction corresponding to a tufting working direction and a second direction substantially perpendicular with respect to the first direction, the tufting structure parameters of the second tufting structure comprising the number of piles of the predetermined tufting structure element in the first direction and the number of piles of the predetermined tufting structure element in the second direction.

The tufting structure parameters of the second tufting structure may further comprise the pile height and/or the pile type of the piles of the predetermined tufting structure element.

It is to be noted that a plurality of additional tufting structures may be provided and, when preparing a tufting process, may be associated with one or a plurality of tufting structure regions. Of course, one particular tufting structure region may have a plurality of tufting structures associated therewith. For example, one particular tufting structure region may have the second tufting structure associated therewith, for providing a repetition of a particular tufting structure element within the area of a fabric to be tufted corresponding to this tufting structure region. The first tufting structure may be superimposed to this second tufting structure, such that the piles of the repeatedly provided tufting structure elements show a variation of the pile height, for example, between two end regions of the area of a fabric corresponding to this particular tufting structure region. Alternatively, starting out from tufting structure elements of the second tufting structure providing at least some piles of equal pile height, in line with a repeated variation of the pile height which is due to the association of the first tufting structure with this particular tufting structure region, there may be a variation of the pile height within each one of the tufting structure elements represented in a fabric.

For making sure that a tufting structure parameter associated with a particular tufting structure region only has an effect within this particular tufting structure region, in association with the pattern representation, a pixel grid may be defined comprising a plurality of pixels following each other in a first direction corresponding to a tufting working direction and a second direction substantially perpendicular with respect to the first direction, each pixel representing one pile of the fabric to be tufted, wherein, in association with at least one tufting structure region, the pixels of the pixel grid comprised within this tufting structure region are determined as being tufting structure region associated pixels, and wherein the tufting structure associated with this tufting structure region is applied to the tufting structure region associated pixels only.

According to a further very advantageous aspect of the present invention, the method may further comprise a step c) of varying the tufting structure of at least one tufting structure region by varying at least one tufting structure parameter of this tufting structure. By providing the option of varying a tufting structure parameter and thereby varying a tufting structure comprising this tufting structure parameter, the structure and/or the optical appearance of the entire tufting structure region having this tufting structure associated therewith is varied. Therefore, stepping into the pixels for varying the information associated with each single pile to be tufted in a particular area of a fabric can be avoided. If varying the tufting structure is not necessary, this step c) needs not to be carried out, although the option of carrying out this step may be provided for allowing such variations, if they are considered to be necessary.

It is a further advantageous aspect of the invention that a variation of tufting structure parameters associated with a particular tufting structure region only has effect in this particular tufting structure region, but does not influence the information associated with all the piles to be tufted outside this particular tufting structure region. Therefore, when carrying out variations to particular tufting structure parameters of a particular tufting structure region, no care has to be taken about the regions outside of this tufting structure region, as these variations have no effect in these other regions.

For avoiding excess and/or unpermitted variations, in association with at least one tufting structure, the tufting structure parameters may comprise variable and non-variable tufting structure parameters, only the variable tufting structure parameters being permitted to be varied. However, it may be provided that at least one of the tufting structure parameters can be switched between being a variable tufting structure parameter and being a non-variable tufting structure parameter.

The method of the present invention may further comprise the step of generating a tufting machine control file on the basis of the tufting structure associated with at least one tufting structure region.

The invention further relates to a method of tufting a fabric, comprising the steps of:

- generating a tufting machine control file by using the method of preparing a tufting process according to the present invention,
- forwarding the tufting machine control file to a tufting machine selected for carrying out the tufting process,
- operating the tufting machine on the basis of the tufting machine control file.

As deficiencies in the appearance of a tufted fabric often only become visible after having tufted at least a part of the fabric, according to the present invention, in association with at least one tufting structure region, at least one tufting structure parameter may be varied after having tufted at least a part of the fabric, and a new tufting machine control file is generated and used in the tufting machine for tufting a new fabric by operating the tufting machine on the basis of this new tufting machine control file.

The present invention will now be explained with reference to the attached drawings, in which.

Figure 1:
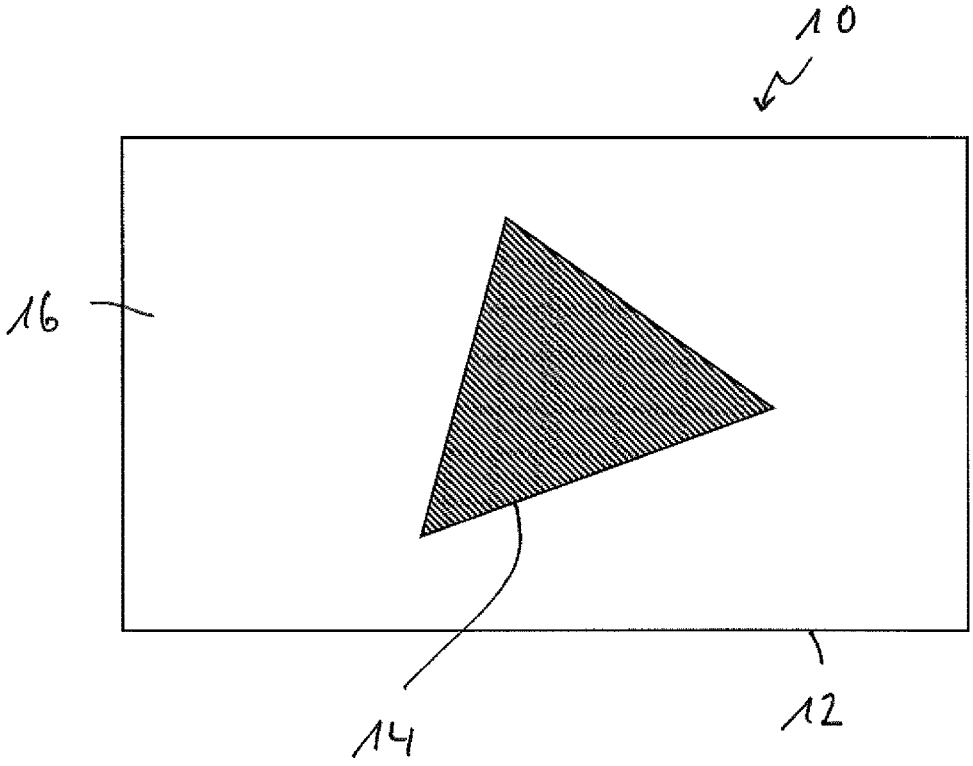
FIG. 1 shows a pattern representation of a fabric to be tufted having a triangular tufting structure region.
Figure 2:
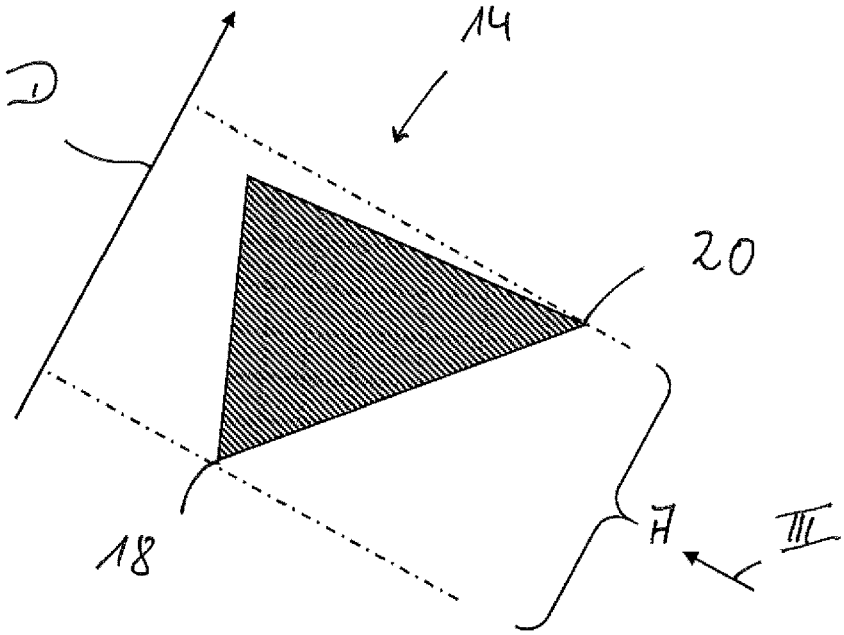
FIG. 2 shows the tufting structure region of FIG. 1 having a first tufting structure associated therewith.

FIG. 1 shows a pattern representation 10 of a fabric to be tufted. For example, the pattern representation 10 may be provided on the basis of an artistic representation which, for example, may be a picture or a drawing showing a triangular region in the center portion thereof. An outline 12 of the pattern representation corresponds to the outer edge of the fabric to be tufted.

In association with the triangle shown in the artistic representation, the pattern representation has a correspondingly triangle-shaped tufting structure region 14 associated therewith. In this particular tufting structure region 14 corresponding to an area of the fabric to be tufted on the basis of this pattern representation 10 comprising a plurality of piles, a specific structure and/or color appearance of the fabric to be tufted will have to be provided in line with the triangle present in the artistic representation. While, as will be explained in the following, in the area of the fabric to be tufted corresponding to the tufting structure region 14, a specific structure will be provided, in the region 16 outside of this tufting structure region 14 and the corresponding area of the fabric to be tufted, respectively, a uniform structure may be provided, for example, by providing equal piles having an equal pile height throughout this area.

In the example shown in FIGS. 1 to 4, a tufting structure will be associated with the tufting structure region 14 representing a variation of the pile height of the piles to be tufted in the area corresponding to this tufting structure region 14. The tufting structure representing this variation of the pile height comprises a plurality of tufting structure parameters. A first one of these tufting structure parameters is the direction D in which the height of the piles varies. A second tufting structure parameter is the extent of the variation of the pile height which, for example, may be defined by the minimum pile height and the maximum pile height.

Figure 3:
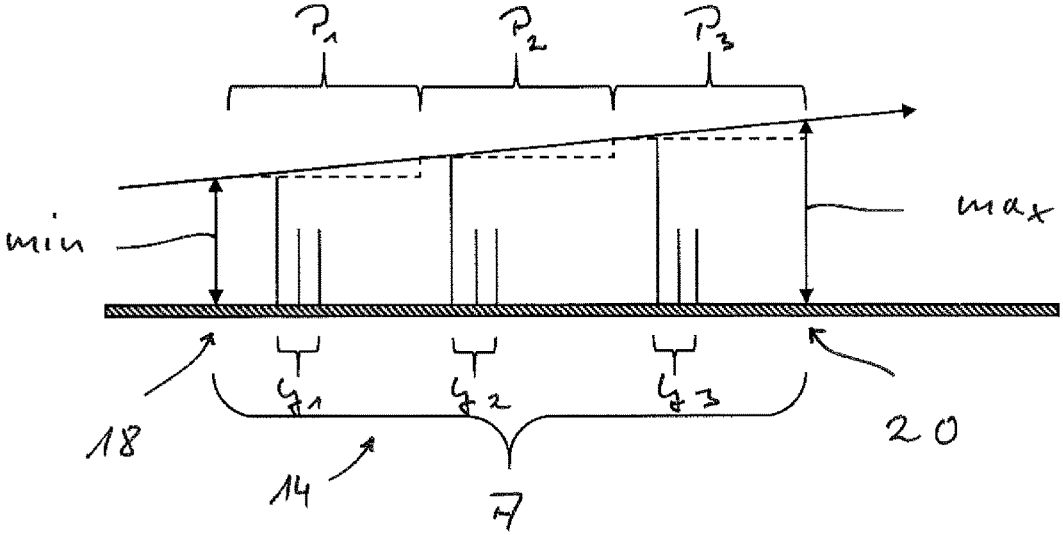
FIG. 3 shows the portion of the pattern representation of FIG. 1 corresponding to the tufting structure region and the associated tufting structure viewed in the direction III in FIG. 2.

In the example shown in FIGS. 1 to 4, the direction D of the variation of the pile height is provided such that, at one tip region 18 of the triangular tufting structure region 14 corresponding to the left end region of area A shown in FIG. 3, the minimum pile height min is provided, while, at another tip region 20 of the triangular tufting structure region 14 corresponding to the right-hand end of the area A shown in FIG. 3, the maximum pile height max will have to be provided. This means that a further tufting structure parameter may define that, within the tufting structure region 14, there should be only one period, i.e. one repetition, of the variation of the pile height. A further tufting structure parameter indicates that the kind of variation which, in the example shown, basically is a linear variation. Due to the fact that some tufting machines have a limited resolution in the variability of the pile height, this linear variation of the pile height which is to be provided in line with one of the tufting structure parameters can be recalculated by, or substituted for, a stepped variation of the pile height shown by a broken line in FIG. 3, each step corresponding to the minimum possible increase/decrease of the pile height provided by the specific tufting machine.

Due to this stepped increase of the pile height between the minimum pile height min and the maximum pile height max, there will be three partial areas $P_1$, $P_2$, $P_3$, each of these partial areas $P_1$, $P_2$, $P_3$ being an area of uniform pile height.

Figure 4:
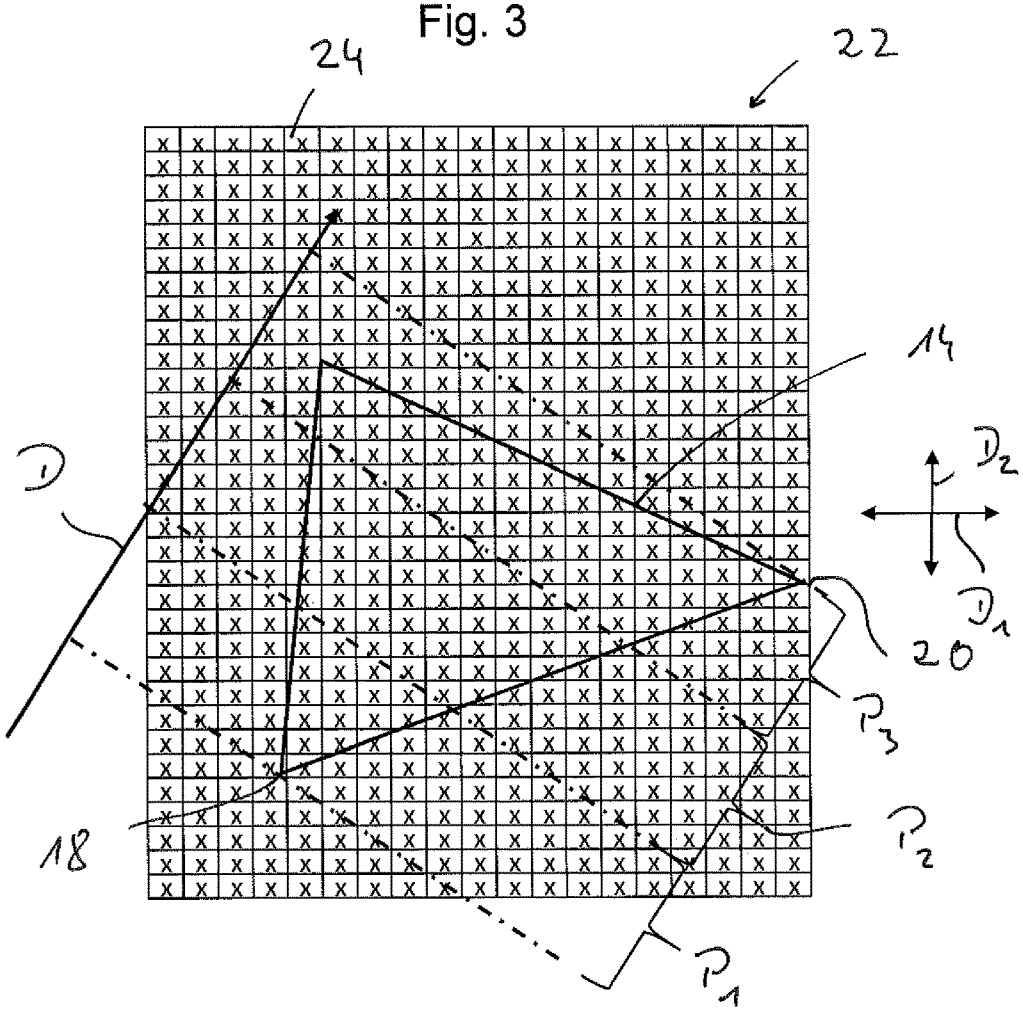
FIG. 4 shows a pixel grid associated with the pattern representation of FIG. 1 in the area of the triangular tufting structure region.

FIG. 4 shows a portion of a pixel grid 22 associated with the pattern representation 10 of FIG. 1. Each pixel 24 of the pixel grid 22 represents one particular pile to be tufted, i.e. one stitch to be carried out by a needle provided on a needle bar of a tufting machine. In FIG. 4, the lines of pixels 24 represent respective piles to be made by one and the same yarn, i.e. by stitches carried out by one and the same needle provided on a needle bar, in particular if the needle bar is not shiftable in a needle bar longitudinal direction thereof. In tufting machines having a needle bar shiftable in the needle bar longitudinal direction, one row of piles corresponding to one line in the pixel grid shown in FIG. 4 can be provided by stitches made by different needles and therefore can be provided by different yarns.

In FIG. 4, direction $D_1$ corresponds to a tufting working direction of a tufting machine, while direction $D_2$, which is substantially perpendicular with respect to direction $D_1$, corresponds to the longitudinal direction of a needle bar and therefore corresponds to the direction in which the needles provided on the needle bar follow each other and, therefore, in which piles generated by adjacent needles follow each other. This direction $D_2$ substantially corresponds to the needle bar longitudinal direction. It is to be noted that each "x" represents one pile to be tufted by making a stitch with a needle of the needle bar.

The tufting structure associated with the tufting structure region 14 and being indicative of the variation of the pile height within this tufting structure region 14 will be applied to those stitches and piles to be tufted, respectively, which are within the area corresponding to the tufting structure region 14. This means that the tufting structure will only be applied to those pixels 24 which are within the tufting structure region 14. All those pixels 24 and the piles to be tufted in association with those pixels which are outside of the tufting structure region 14 will not be influenced by the tufting structure associated with the tufting structure region 14. For example, as stated above, in all those pixels 24 outside of the tufting structure region 14, piles of a uniform pile height may be provided. The decision as to whether or not a particular pile to be tufted is within the tufting structure region 14, for example, can be taken on the basis of the portion of the area of a respective pixel 24 inside the tufting structure region 14. If this portion is above 50%, then a respective pixel 24 may be determined to be a tufting structure region associated pixel associated with this particular tufting structure region 14. Of course, other ways for determining whether a particular pixel 24 is within or outside of a particular tufting structure region can be used.

In FIG. 3, three groups $G_1$, $G_2$, $G_3$ of piles to be tufted are shown in association with the three partial areas $P_1$, $P_2$, $P_3$. Each group $G_1$, $G_2$, $G_3$ may represent a group of piles to be tufted by means of three immediately adjacent needles of the needle bar. For example, these groups $G_1$, $G_2$, $G_3$ may be determined on the basis of a color repeat provided by the yarn threading associated with the needles of the needle bars. Therefore, each of these three groups $G_1$, $G_2$, $G_3$ corresponds to three lines of the pixel grid 22 shown in FIG. 4.

A further tufting structure parameter of the tufting structure associated with tufting structure region 14 may define which one of the yarns provided within each one of the groups $G_1$, $G_2$, $G_3$ will be used for generating a pile having a pile height corresponding to the varying pile height of this particular tufting structure. In the example shown, only one of the three yarns is used for providing such a varying pile height, while, in association with the other two yarns, piles of uniform, not varying height have to be generated within the area corresponding to the tufting structure region 14. In another example, all the yarns threaded through the needles of the needle bar can be used for providing such a varying pile height.

By defining a tufting structure by using a plurality of tufting structure parameters, for example, the minimum pile height, the maximum pile height, the kind of variation of the pile height and the direction of variation, and associating such a tufting structure with a particular tufting structure region, the structure of the fabric to be tufted in the area corresponding to this tufting structure region is determined without there being the necessity of separately defining each single pile to be tufted in association with each particular pixel 24 within such a tufting structure region by means of providing information about the pile height separately in association with each single pixel 24 and each pile to be tufted, respectively. Only a reduced number of parameters is necessary for defining a clear structure of an entire tufting structure region and therefore an entire area of a fabric to be tufted corresponding to such a tufting structure region. Of course, even when providing the information about the respective piles to be tufted in line with the principles of the present invention, corresponding information about the pile height and the pile type will be provided in association with each single pixel 24 of pixel grid 22 and therefore in association with each single stitch to be carried out when tufting a fabric. Therefore, it might be advantageous to provide a plurality of virtual layers depictable on a monitor, each layer showing those pixels in which identical information about the piles to be tufted is present, i.e. showing those pixels representing identical piles. When providing such separated layers, deficiencies occurring when transforming the image representation into a set of data usable for tufting a fabric become more obvious, and corrections can be made for overcoming such deficiencies, for example, by taking a particular pixel associated with a tufting structure region out of the tufting structure region and associating such a pixel with the region surrounding this tufting structure region and, for example, providing another pile height for the piles to be tufted in this region.

When preparing a process for tufting a fabric and when carrying out a process for tufting a fabric, providing an artistic representation and transferring the artistic representation to a pattern representation, associating tufting structure regions with the pattern representation and associating tufting structures with the tufting structure regions will normally be done by a designer who can be considered as being some kind of artist experienced in all the options the tufting process provides and who therefore is able to carry out this transfer of the information represented by the image representation to a set of data represented by a pixel grid, each pixel representing one pile and one stitch to be carried out, respectively, for providing a particular type of pile having a particular pile height at a particular location. This, for example, can be done by inputting corresponding data into a data processing means, for example, comprising a programmed microprocessor and/or by selecting corresponding information depicted on a screen of a data processing means for thereby generating the corresponding sets of data. On the basis of such a set of data, a tufting machine control file can be generated which is input into the control system of the tufting machine for carrying out a tufting process on the basis of these data. There may be an operator of the tufting machine who might be less experienced insofar as the artistic aspects are concerned, but who has enhanced experience in working with the tufting machine and the options provided by such a tufting machine when carrying out a tufting process. Normally, such an operator will be able to locate particular deficiencies in the set of data used for generating the tufting machine control file, for example, when being depicted in the form of separated or superimposed layers, as stated above. Of course, such an operator will be able to see such deficiencies after having tufted a particular fabric.

In line with the principles of the present invention, due to the reduced amount of information necessary for defining the tufting structure of an entire tufting structure region, it is easily possible to carry out variations for overcoming such deficiencies or for enhancing the structural and/or optical appearance of a fabric. If, for example, the operator is of the opinion that, in the tip region 20, there is a too sharp transition between the maximum pile height max provided within the tufting structure region 14 and the pile height provided in the region surrounding the tufting structure region 14, in line with the principles of the present invention, the operator is allowed to vary the maximum pile height being one of the tufting structure parameters, for example, by reducing the maximum pile height and therefore reducing the difference between the height of the piles provided within the tufting structure region 14 and the height of the piles outside of the tufting structure region 14. This, for example, can be done after a first fabric has been tufted and after such a too sharp transition has been discovered. Of course, such a variation can even be carried out before starting the tufting process, if it is discovered early enough and if it is obvious that there will be such a deficiency. In this case, such a variation can be carried out even before having generated the tufting machine control file. If a tufting machine control file has already been generated and used for tufting a fabric, a new tufting machine control file can be generated after having carried out such a variation for then tufting a new fabric.

Within the principles of the present invention, it can be decided which tufting aspect parameters are permitted to be varied. For example, it might be that only the extent of the variation is permitted to be varied, for example, by varying the maximum pile height max and/or the minimum pile height min, while a variation of the direction D and/or a variation of the kind of variation of the pile height are not permitted to be changed. There even might be provided the option of switching particular tufting structure parameters between either being a tufting structure parameter which is permitted to be varied or being a tufting structure parameter which is not permitted to be varied. For example, the designer basically preparing the set of data used for generating the tufting machine control file may be the one who decides which tufting structure parameters may be varied by the operator.

Figure 5:
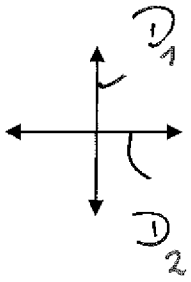
FIG. 5 shows a tufting structure element of a second tufting structure.

FIG. 5 shows another example of a tufting structure which might be associated with tufting structure region 14. The tufting structure shown in FIG. 5 is based on a tufting structure element 26 defining a plurality of stitches to be carried out and piles to be generated, respectively. In the tufting structure element 26, the lines shown in FIG. 5 may represent stitches to be carried out by the same needle and therefore piles to be generated by the same yarn. The columns will extend in the first direction $D_1$ corresponding to the tufting working direction of a tufting machine. The lines represent rows of stitches and rows of piles, respectively, generated by immediately adjacent needles of a needle bar and extend in a direction $D_2$ substantially perpendicular with respect to direction $D_1$.

The tufting structure element 26 shown in FIG. 5 contains four different areas represented by different pile heights "2", "5" on the one hand and "3", "8" on the other hand. Each such number stands for a particular pile height which, for example, might be expressed in millimeters. The pile heights provided within such a tufting structure element 26 as well as the number of piles covered by such a tufting structure element 26 in the two directions $D_1$ and $D_2$ can be considered as being tufting structure parameters. If a plurality of such tufting structure elements 26 are provided for selection, the information indicating a particular one of these tufting structure elements can also be considered as being a tufting structure parameter.

The tufting structure provided on the basis of such tufting structure elements 26 defines the repeated provision of such tufting structure elements 26 following each other in directions $D_1$ and $D_2$ within a tufting structure region having such a tufting structure associated therewith. By varying the numbers of piles and pixels, respectively, covered by such a structure element 26 and/or by varying the pile heights within the respective pixels, an effect on all the piles to be tufted in an area corresponding to such a tufting structure region can be obtained, while there will be no influence on the piles tufted outside of such a region. The variation within such a tufting structure may also comprise the substitution of one kind of tufting structure element for another kind of tufting structure element, if this might provide an enhanced appearance.

It is to be noted that, of course, other or additional tufting structures may be provided and associated with different tufting structure regions of a pattern representation. Of course, such a pattern representation may contain a plurality of tufting structure regions. For example, the entire region 16 shown in FIG. 1 as surrounding tufting structure region 14 may be another tufting structure region having a specific tufting structure associated therewith. Further, a plurality of tufting structures may be associated with one and the same tufting structure region.

The decision to vary one or a plurality of the tufting structure parameters of a tufting structure associated with a particular tufting structure region, of course, can be provided in an automated manner. For example, after having generated a complete set of data defining all the piles to be generated when carrying out a tufting process, it may be checked whether there are particular areas in which a too sharp transition between adjacent piles occurs. A threshold for a maximum height transition between adjacent piles of a fabric to be tufted may be defined. If it is determined that, at a particular location, this threshold is exceeded, one of the tufting structure parameters, for example the maximum pile height, may varied. Further, the variation of a tufting structure parameter, for example the minimum pile height, may be limited to a predetermined allowable range which, for example, may be defined with respect to an other tufting structure parameter, for example the maximum pile height. For example, the minimum pile height may be allowed to be varied in a range of 20% to 50% of the maximum pile height.

The new set of data may be checked once more and, if the threshold is still exceeded, the corresponding tufting structure parameter may be varied once more. If the threshold is not exceeded, the tufting machine control file can be generated on the basis of this set of data for then tufting a fabric with using this tufting machine control file.

Finally, it is to be noted that, in line with the principles of the present invention, the expression "at least a part of the piles" is to be understood such as to refer to at least two piles.

The invention claimed is:

1. A method of preparing a tufting process for tufting a fabric, comprising:

a) providing a pattern representation representative of the fabric to be tufted comprising at least one tufting structure region, said at least one tufting structure region corresponding to an area of the fabric to be tufted having a plurality of piles, and b) in association with the at least one tufting structure region, providing at least one tufting structure defined by a plurality of tufting structure parameters, each tufting structure parameter having an effect on an appearance of at least a part of the plurality of piles to be tufted in association with the at least one tufting structure region and having no effect on an appearance of piles to be tufted in an area not corresponding to the at least one tufting structure region;

wherein a first tufting structure of the at least one tufting structure defines a variation of a pile height within the at least one tufting structure region having the first tufting structure associated therewith, and wherein one or more of the plurality of tufting structure parameters defining the first tufting structure comprise a direction of the variation and an extent of the variation.

2. The method according to claim 1, wherein the extent of the variation is defined by a maximum pile height and a minimum pile height.

3. The method according to claim 1, wherein the one or more of the plurality of tufting structure parameters defining the first tufting structure further comprise a kind of the variation of the pile height, and/or wherein the one or more of the plurality of tufting structure parameters defining the first tufting structure further comprise a number of repetitions of the variation of the pile height within the associated tufting structure region.

4. The method according to claim 1, wherein a second tufting structure of the at least one tufting structure defines a repetition of a predetermined tufting structure element, the predetermined tufting structure element defining a plurality of piles to be tufted adjacent to each other in a first direction corresponding to a tufting working direction and a second direction substantially perpendicular with respect to the first direction, one or more of the plurality of tufting structure parameters defining the second tufting structure comprising a number of piles of the predetermined tufting structure element in the first direction and a number of piles of the predetermined tufting structure element in the second direction.

5. The method according to claim 4, wherein the one or more of the plurality of tufting structure parameters defining the second tufting structure comprise a pile height and/or a pile type of the piles of the predetermined tufting structure element.

6. The method according to claim 1, wherein, in association with the pattern representation, a pixel grid is defined comprising a plurality of pixels following each other in a first direction corresponding to a tufting working direction and a second direction substantially perpendicular with respect to the first direction, each pixel representing one pile of the fabric to be tufted, wherein, in association with the at least one tufting structure region, the pixels of the pixel grid comprised within the at least one tufting structure region are determined as being tufting structure region associated pixels, and wherein the at least one tufting structure associated with this tufting structure region is applied to the tufting structure region associated pixels only.

7. The method according to claim 1, further comprising a step c) of varying the at least one tufting structure of the at least one tufting structure region by varying at least one of the plurality of tufting structure parameters of the at least one tufting structure.

8. The method according to claim 7, wherein, in association with the at least one tufting structure, the plurality of tufting structure parameters comprise variable and non-variable tufting structure parameters, wherein only the variable tufting structure parameters are permitted to be varied.

9. The method according to claim 8, wherein at least one of the plurality of tufting structure parameters can be switched between being a variable tufting structure parameter and being a non-variable tufting structure parameter.

10. The method according to claim 1, further comprising generating a tufting machine control file on a basis of the at least one tufting structure associated with the at least one tufting structure region.

11. A method of tufting a fabric, comprising:

generating a tufting machine control file by using the method of claim 1, forwarding the tufting machine control file to a tufting machine selected for carrying out the tufting process, and operating the tufting machine on a basis of the tufting machine control file.

12. The method according to claim 11, wherein, after having tufted at least a part of the fabric, in association with the at least one tufting structure region, at least one of the plurality of tufting structure parameters is varied and a new tufting machine control file is generated and used in the tufting machine for tufting a fabric by operating the tufting machine on the basis of this new tufting machine control file.

* * * * *